US007845965B2

(12) United States Patent
Ko

(10) Patent No.: US 7,845,965 B2
(45) Date of Patent: Dec. 7, 2010

(54) CABLE CONNECTOR ASSEMBLY WITH AN IMPROVED SPACER

(75) Inventor: David Tso-Chin Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/492,156

(22) Filed: Jun. 26, 2009

(65) Prior Publication Data

US 2009/0325417 A1 Dec. 31, 2009

(30) Foreign Application Priority Data

Jun. 26, 2008 (CN) ..... 200820040922

(51) Int. Cl.
*H01R 13/627* (2006.01)

(52) U.S. Cl. ..... 439/352; 439/607.55

(58) Field of Classification Search ..... 439/352, 439/350, 353, 607.55, 358
See application file for complete search history.

(56) References Cited

U.S. PATENT DOCUMENTS 4,620,762 A * 11/1986 Davis et al. ..... 439/350
6,390,852 B1 5/2002 Wang
6,659,804 B2 12/2003 Nishio
7,175,465 B1 * 2/2007 Tsai ..... 439/352
7,314,383 B1 * 1/2008 Ho et al. ..... 439/353
7,422,465 B2 * 9/2008 Watanabe et al. ..... 439/353
7,442,066 B1 * 10/2008 Ho et al. ..... 439/358
7,686,656 B2 * 3/2010 Zheng et al. ..... 439/660
7,690,948 B2 * 4/2010 Lung ..... 439/607.27
2005/0282424 A1 * 12/2005 Huang et al. ..... 439/353
2007/0099515 A1 * 5/2007 Wang ..... 439/660
2007/0141890 A1 * 6/2007 Koyama ..... 439/358
2007/0141891 A1 6/2007 Koyama

* cited by examiner

*Primary Examiner*—Hae Moon Hyeon
(74) *Attorney, Agent, or Firm*—Wei Te Chung; Andrew C. Cheng; Ming Chieh Chang

(57) ABSTRACT

A cable connector assembly includes an insulative housing (1) with a number of passages (101), a shell (3) covering the insulative housing, a number of contacts (2) received in the passages of the insulative housing, and a spacer (5) assembled to the insulative housing. The contact includes a retaining portion (22), an extending portion (25) extending form the retaining portion and a soldering portion (23) bending from the end of the extending portion, and the all soldering portions are coplanar. The spacer includes a pressing portion (52) and a vertical wall (53). The pressing portion presses on the retaining portion of the contact, and the vertical wall engages with the soldering portion of the contact.

17 Claims, 5 Drawing Sheets

CABLE CONNECTOR ASSEMBLY WITH AN IMPROVED SPACER

BACKGROUND OF THE INVENTION

1. Field of the Invention

The present invention relates generally to a cable connector assembly, and particularly to a Micro Universal Serial Bus (Micro USB) connector assembly with an improved spacer.

2. Description of Prior Art

The cable connector assembly with an Universal Serial Bus (USB) connector has been used in electronics for years, such as cell phones, MP3, and DVD player. Nowadays, the size of cable connector assembly becomes much smaller and smaller to meet the miniaturization requirement of the electronic device, so a Micro Universal Serial Bus (Micro USB) connector assembly comes forth and is used widely.

The Micro USB connector generally comprises an insulative housing, a plurality of contacts received in the housing, a pair of latches located at the opposite sides of the housing, and a top and bottom shells shielding the housing. The insulative housing forms a base portion with a plurality of terminal channels thereon, and the contacts are inserted into the channels and retained by the housing. The disadvantage of this connector as follows: each contact of the connector has a soldering portion, and these soldering portions are arranged into upper and lower rows, and this means the conductive wires from a cable have to me soldered to the upper and lower soldering portions respectively.

Hence, it is desirable to have an improved cable connector assembly to overcome the above-mentioned disadvantages of the prior art.

BRIEF SUMMARY OF THE INVENTION

Accordingly, the object of the present invention is to provide a cable connector assembly having a spacer for holding the contacts on the housing firmly.

The other object of the present invention is to provide a cable connector assembly with an improved contacts arrangement for soldering conveniently.

In order to achieve the above-mentioned object, a cable connector assembly comprises an insulative housing with a plurality of passages, a shell covering the insulative housing, a plurality of contacts received in the passages of the insulative housing, a spacer assembled to the insulative housing, and a cable electrically terminated with at least two of the contacts. The contact comprises a retaining portion and a soldering portion extending rearwards beyond the housing, the soldering portions are coplanar with each other. The spacer comprises a pressing portion and a vertical wall. The pressing portion engages on the retaining portion of the contact, and the vertical wall engages with the soldering portion of the contact.

Other objects, advantages and novel features of the invention will become more apparent from the following detailed description of the present embodiment when taken in conjunction with the accompanying drawings.

DETAILED DESCRIPTION OF THE INVENTION

Figure 1:
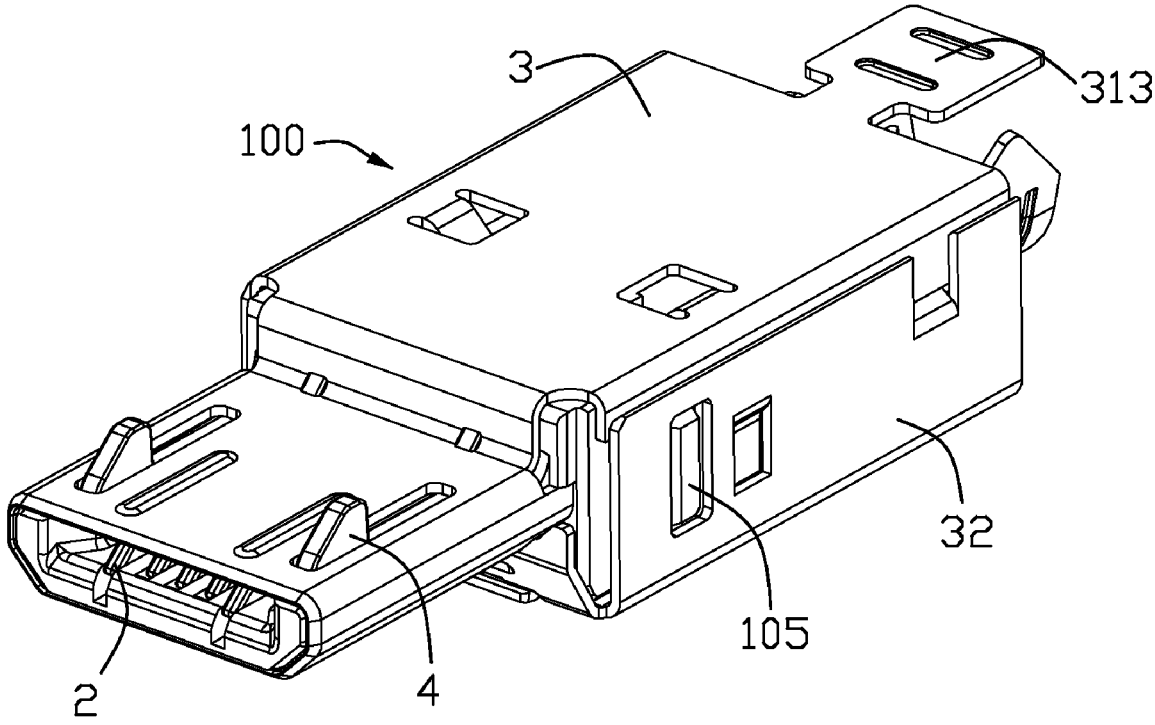
FIG. 1 is a perspective view of a cable connector assembly in accordance with the present invention.

Reference will now be made to the drawing figures to describe the present invention in detail.

Referring to FIG. 1 to FIG. 4, a cable connector assembly 100 in accordance with the present invention, for example a Micro Universal Serial Bus (Micro USB) connector assembly, comprises an insulative housing 1 with a plurality of contacts 2 assembled therein, a shell 3 covering the insulative housing 1, a pair of latches 4 located at the opposite sides of the contacts 2, a spacer 5 holding on the insulative housing 1 and a cable 6 soldered on the contacts 2.

Figure 2:
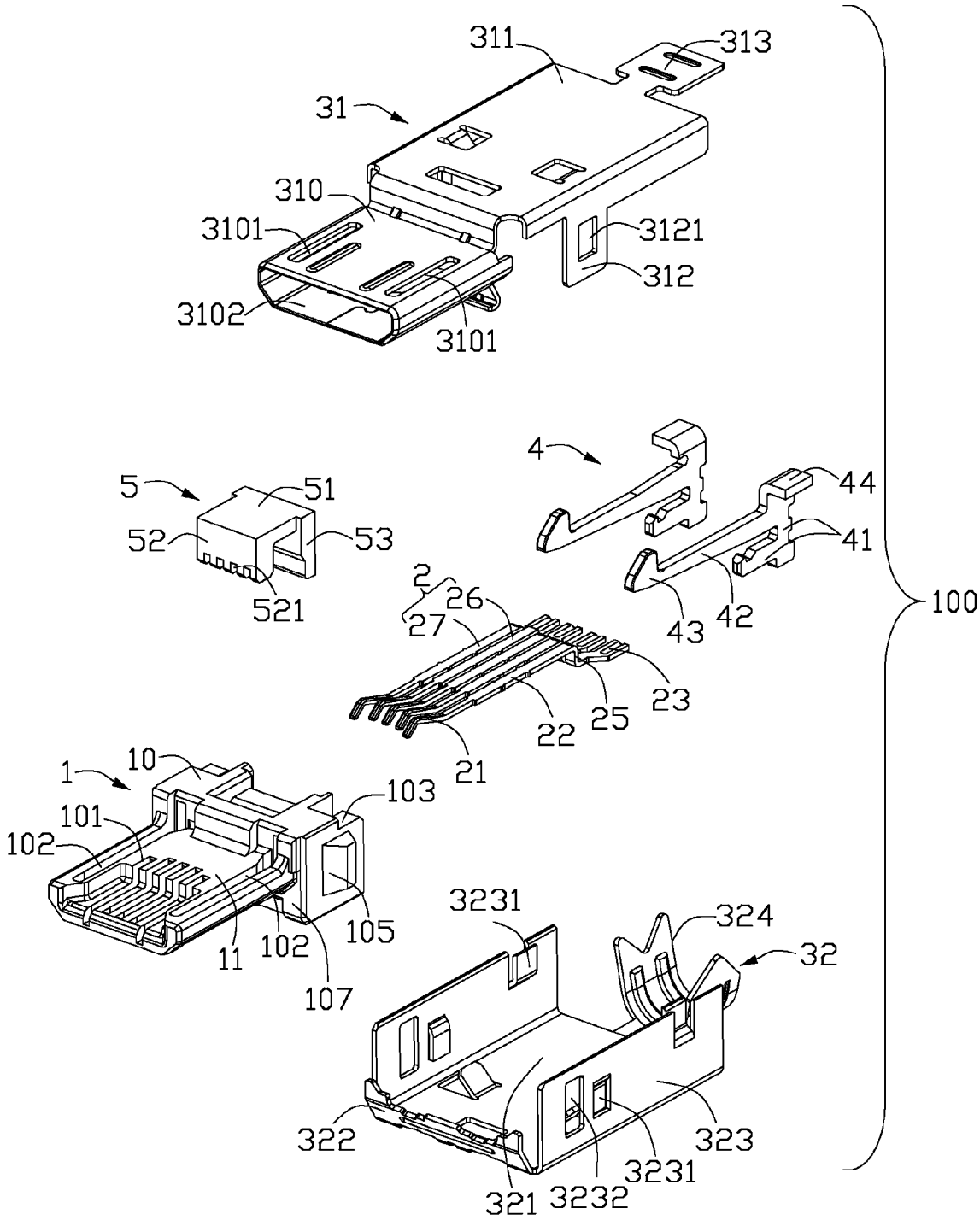
FIG. 2 is an exploded, perspective view of the cable connector assembly shown in FIG. 1.
Figure 3:
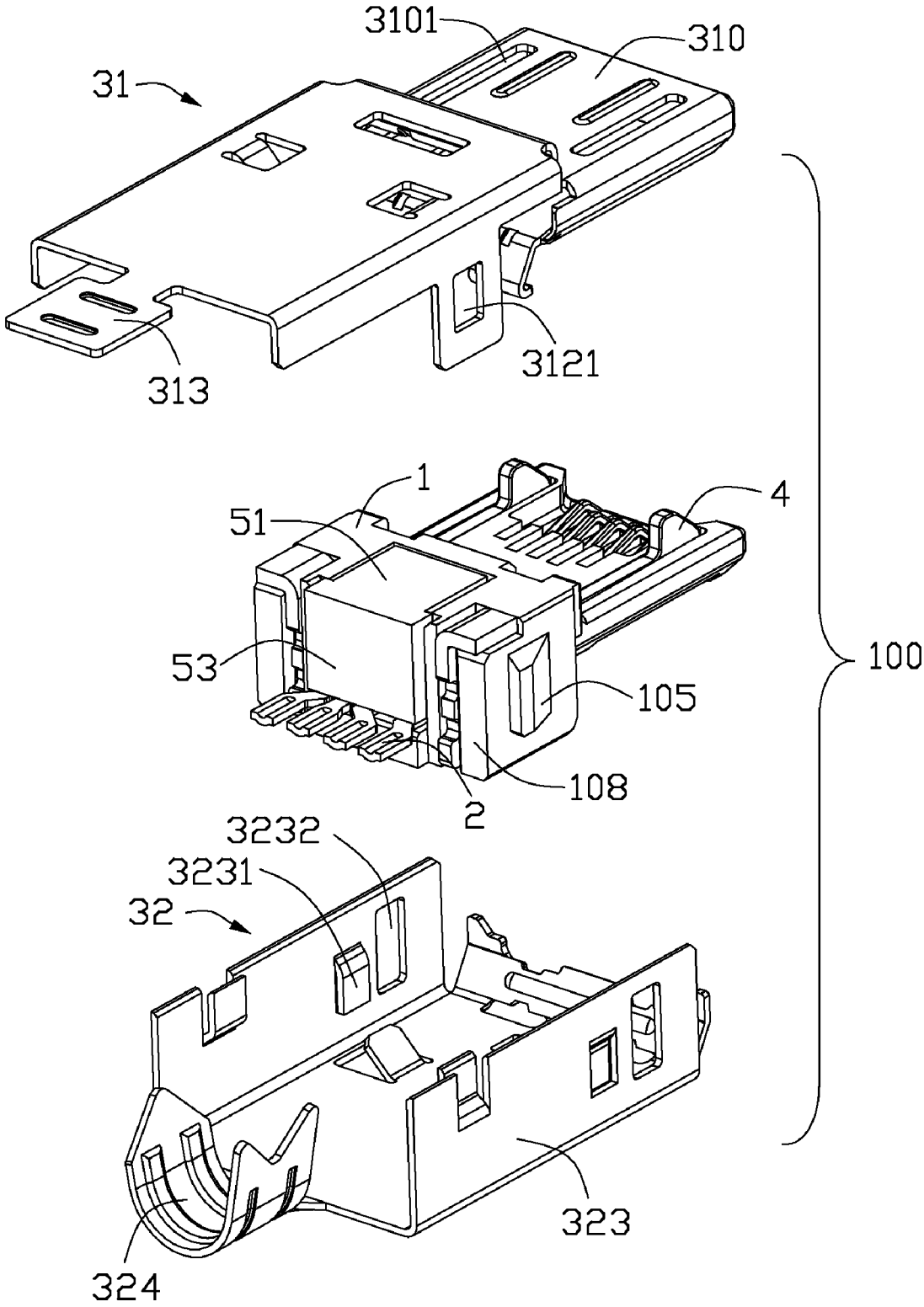
FIG. 3 is a view similar to the FIG. 2, but taken from other aspect.
Figure 4:
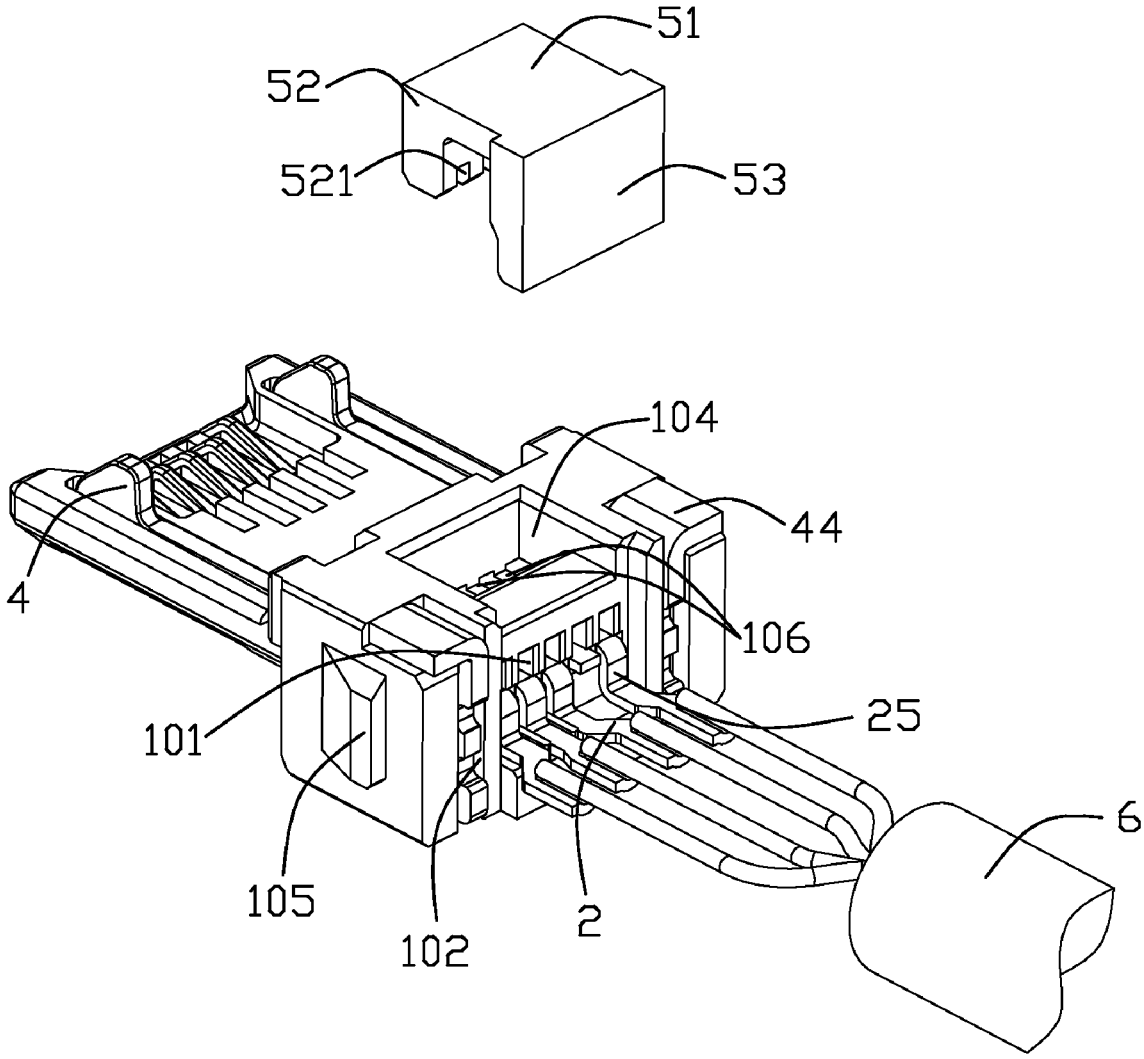
FIG. 4 is a perspective view of the cable connector assembly with the contacts soldered to a cable.
Figure 5:
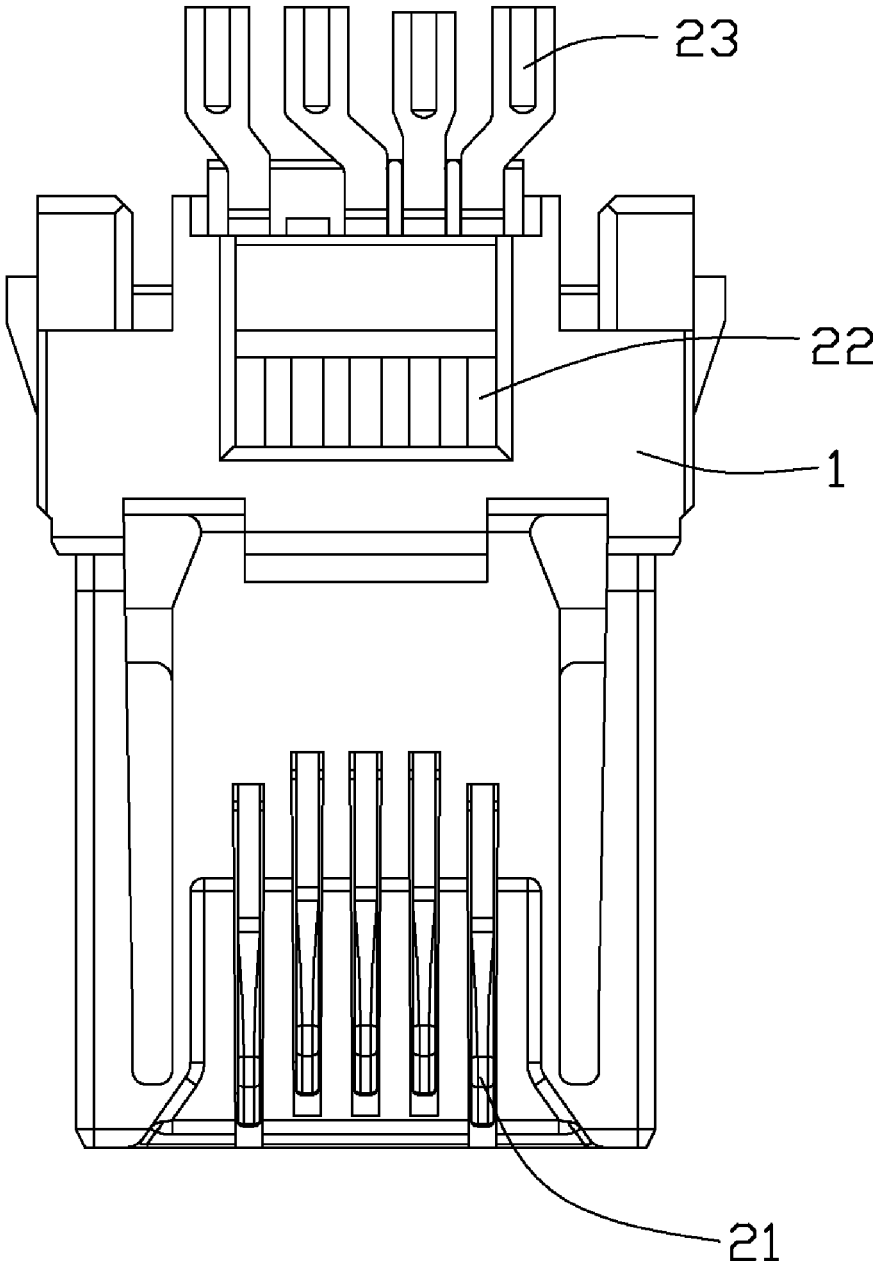
FIG. 5 is a top view of the insulative housing with the terminals assembled therein.

Referring to FIG. 2 to FIG. 4, the insulative housing 1 comprises a base portion 10 and a mating portion 11 extending forwardly from the base portion 10 in a front-to-rear direction. The mating portion 11 is alternatively named as a mating tongue 11. The base portion 10 comprises a front face 107 from which the mating portion 11 extends and a rear face 108 opposite to the front face 107. The base portion 10 has a plurality of passages 101 penetrating through the base portion 10 and the mating portion 11. A flange 106 is formed between two passages 101. The base portion 10 further comprises a pair of grooves 102 located at the opposite sides of the passages 101 for receiving the latches 4, and a step portion 103 mounted at the rear end thereof. The top surface of base portion 10 defines a hole 104 communicating with the passages 101. The two lateral sides of the base portion 10 further comprises a tuber 105, respectively.

Each contact 2 is received in the passage 101 of the housing 1 and comprises a contacting portion 21 exposed to the mating portion 11 and a retaining portion 22 disposed in part of the mating portion 11 and the base portion 10. The retaining portions 22 are equidistantly spaced with each other for defining a first interval (not labeled). The contacts 2 comprise a first contact 26 and a plurality of second contacts 27. Each second contact 27 further comprises an extending portion 25 extending downwardly from the retaining portion 22 and a soldering portion 23 bending horizontally from the extending portion 25. The first contact 26 is used to keep the cable connector assembly 100 mating with a complementary connector (not shown) steadily, and it does not have the extending portion 25 and the soldering portion 23. In a preferred embodiment of the present invention, the number of the second contacts 27 is four, but which is not limiting, and the single first contact 26 is placed between two of the second contacts 27. One of the soldering portions 23 of the second contacts 27 straightly, downwardly extends from the corresponding extending portion 25, and other soldering portions 23, which are located at two lateral sides of the abovementioned one of the soldering portions 23, obliquely, downwardly extend from the corresponding extending portions 25 for defining a commonly equidistant second interval (not labeled) therebetween, which is larger than the first interval of the retaining portions 22. These soldering portions 23 arrange in a first plane and are coplanar for soldering with the cable 6 conveniently, and the retaining portions 22 are disposed in a second plane parallel to the first plane. The contacting portion 21, the retaining portion 22, and the soldering portion 23 are respectively, correspondingly renamed as a mating section 21, a rear retention section 22, a connection section 23, and accordingly, one of the contacts (the first contact 26) only has the corresponding mating section 21 and the rear retention section 22 without the corresponding connection section 23 while other contacts (the second contacts 27) further have the connection sections 23 other than the mating sections 21 and the rear retention sections 22.

The shell 3 is assembled to the insulative housing 1 in the front-to-rear direction, and comprises a top shell 31 and a bottom shell 32. The top shell 31 comprises a main portion 311, a front portion 310 located at the front end of the main portion 311, a rear portion 313 located at the rear end of the main portion 311, and a pair of side walls 312 extending downwardly from the main portion 311. The front portion 310 mates with the mating portion 11 of the housing 1, and it comprises an opening 3102 for receiving a complementary connector (not shown) in the front thereof and a pair of slot 3101 extending in the front-to-rear direction in the top surface thereof. The side wall 312 forms a gap 3121 for receiving the tuber 105 of the housing 1.

The bottom shell 32 is assembled on the top shell 31, and comprises a second main portion 321, a stop portion 322 located at the front end of the second main portion 321, a pair of second side walls 323 extending upwardly from the opposite sides of the second main portion 321 and a tight-fitting portion 324 located at the rear end of the second main portion 321. The second side wall 323 forms a plurality of retaining pieces 3231 for mating with the side wall 312 of the top shell 31. And the second side wall 323 further comprises a gap 3232 communicating with the gap 3121 of the top shell 31, and these gaps 3121, 3232 mate with the tuber 105 of the housing 1 for retaining the shell 3 on the housing 1. A receiving space (not labeled) is defined between the main portion 311 and the second main portion 321 for receiving the base portion 10 of the housing 1.

The pair of latches 4 are retained by grooves 102 of the housing 1, and each comprises a retaining arm 41, a spring arm 42 extending forwardly from the retaining arm 41, a hook portion 43 located at the end of the spring arm 42 and a bending portion 44 extending outwardly from the top end of the retaining arm 41. The hook portion 43 extends out of the top surface of the shell 3 through the slot 3101. The bending portion 44 mates with the step portion 103 of the housing 1 for holding the latch 4 on the insulative housing 1.

The spacer 5 is assembled to the insulative housing 1, and comprises a horizontal portion 51, a pressing portion 52 extending downwardly from the front end of the horizontal portion 51 and a vertical wall 53 extending downwardly from the rear end of the horizontal portion 51. Actually, the spacer 5 is U-shaped structured and has two spaced arms 52, 53, with a front section 52 thereof shorter than a rear section 53 thereof. The pressing portion 52 passes through the hole 104 of the housing 1 and presses on the retaining portion 22 of the contacts 2 for holding the contacts 2 in the passages 101 firmly, and it further comprises a plurality of recesses 521 at the bottom thereof for mating with the flanges 106. The vertical wall 53 covers the passages 101 to prevent the plastics material floating into the passages 101. And the bottom face of the vertical wall 53 engages with the top surface of the soldering portions 23 of the contacts 2, which supports on the extending portion 25 of the contact 2 to avoid the contacts 2 dropping out from the passages 101.

The assembly procedure of the cable connector assembly 100 as follows: first, the contacts 2 and the latches 4 are inserted into the insulative housing 1, and then the spacer 5 is assembled to the insulative housing 1. Second, the cable 6 is soldered to the soldering portion 23 of the contacts 2, at the same time, the top shell 31 and the bottom shell 32 are assembled together. Third, the shell 3 is assembled to the insulative housing 2 in the front-to-rear direction to finish the assembly procedure.

The spacer 5 prevents the contacts 2 removing from the insulative housing 1. The soldering portions 23 of the contacts 2 arrange in a line and are coplanar for soldering with the cable 6 conveniently.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an insulative housing with a plurality of passages;

a shell covering the insulative housing;

a plurality of contacts received in the passages of the insulative housing, each contact comprising a retaining portion and a soldering portion extending rearwards beyond the housing, the soldering portions being coplanar with each other;

a spacer assembled to the insulative housing and comprising a pressing portion and a vertical wall; and a cable electrically contacting with the contacts;

wherein said pressing portion engages on the retaining portion of the contact, and the vertical wall engages with the soldering portion of the contact.

2. The cable connector assembly as claimed in claim 1, wherein the insulative housing comprises a base portion and a mating portion extending from the base portion in a front-to-rear direction, and wherein the base portion forms a hole receiving the pressing portion of the spacer.

3. The cable connector assembly as claimed in claim 2, wherein the pressing portion comprises a plurality of recesses at a bottom thereof.

4. The cable connector assembly as claimed in claim 3, wherein the spacer comprises a horizontal portion connecting the pressing portion and the vertical wall.

5. The cable connector assembly as claimed in claim 1, further comprising a pair of latches assembled on the housing, wherein the latch extends through the housing along a front-to-back direction with a hook portion formed at a front end thereof.

6. A cable connector assembly comprising:

an insulative housing extending in a front-to-back direction;

a shell enclosing the insulative housing and cooperating with the insulative housing to form a mating portion;

a first contact held in the housing with a first contact portion exposed to the mating portion;

a plurality of second contacts held in the housing with second contact portions exposed to the mating portion, said second contacts having soldering portion extending out of the housing and equidistantly arranged in a first plane, the first contact being placed between two of the second contacts and each contact having a retaining portion equidistantly spaced with each other;

a spacer assembled to the housing, and comprising a pressing portion and a vertical wall, the bottom face of the pressing portion engaging with the retaining portions, and the bottom face of the vertical wall engaging with the soldering portions; and a plurality of wires connecting to the second contacts;

wherein the retaining portions are disposed in a second plane parallel to the first plane.

7. The cable connector assembly as claimed in claim 6, wherein the housing includes a base portion and a mating portion extending forwards from the base portion with a plurality of passageways extending through the base portion and the mating portion.

8. The cable connector assembly as claimed in claim 6, wherein the shell includes a top shell and the a bottom shell attached to opposite side of the housing.

9. The cable connector assembly as claimed in claim 8, further comprising a pair of latches disposed at the opposite sides of the contacts and extending along a front-to-back direction, respectively.

10. The cable connector assembly as claimed in claim 9, wherein each latch includes a hook portion projecting into the mating portion and extending out of the shell.

11. The cable connector assembly as claimed in claim 6, wherein every two adjacent retaining portions define a first interval therebetween, and every two adjacent soldering portions define a second interval therebetween, which is larger than the first interval.

12. A cable connector assembly comprising:

an insulative housing including a mating tongue;

a plurality of passageways extending along a front-to-back direction in the housing;

a plurality of contacts forwardly inserted into the corresponding passageways from a rear face of the housing, respectively, each of said contacts including a mating section around the mating tongue and a connection section around the rear face and a rear retention section between the mating section and the connection section except that one of said contacts only has the corresponding mating section and the retention section while without the corresponding connection section; and a spacer assembled to the housing and including a front section engaging the retention section, and a rear section engaging the connection section; wherein said one of the contacts engages said spacer only at the corresponding retention section while the remaining contacts engage said spacer at both the corresponding retention sections and connection sections.

13. The cable connector assembly as claimed in claim 12, wherein said spacer defines a U-shaped structure having two spaced arms, and the front section and the rear section are respectively located on the two spaced arms.

14. The cable connector assembly as claimed in claim 13, wherein the front section is shorter than the rear section.

15. The cable connector assembly as claimed in claim 12, wherein the rear section prevents rearward movement of the contact.

16. The cable connector assembly as claimed in claim 12, wherein the rear section prevents upward movement of the connection section.

17. The cable connector assembly as claimed in claim 12, wherein said spacer and said housing are configured to only allow said spacer to be assembled to the housing in a vertical direction perpendicular to said front-to-back direction.

* * * * *